US010034537B2

(12) United States Patent
Long, Jr. et al.

(10) Patent No.: US 10,034,537 B2
(45) Date of Patent: Jul. 31, 2018

(54) DESKTOP ACCESSORY FOR LUGGAGE

(71) Applicants: Robert Ernest Long, Jr., Kennesaw, GA (US); Alana Boleman Long, Kennesaw, GA (US)

(72) Inventors: Robert Ernest Long, Jr., Kennesaw, GA (US); Alana Boleman Long, Kennesaw, GA (US)

( * ) Notice: Subject to any disclaimer, the term of this patent is extended or adjusted under 35 U.S.C. 154(b) by 0 days.

(21) Appl. No.: 15/814,102

(22) Filed: Nov. 15, 2017

(65) Prior Publication Data

US 2018/0132606 A1 May 17, 2018

Related U.S. Application Data

(60) Provisional application No. 62/422,911, filed on Nov. 16, 2016.

(51) Int. Cl.

| | |
|---|---|
| ***A47B 5/04*** | (2006.01) |
| ***A45C 13/28*** | (2006.01) |
| ***A47B 3/10*** | (2006.01) |
| ***A45C 9/00*** | (2006.01) |
| *A45C 5/03* | (2006.01) |

(52) U.S. Cl.

CPC ..... *A47B 5/04* (2013.01); *A45C 9/00* (2013.01); *A45C 13/28* (2013.01); *A47B 3/10* (2013.01); *A45C 5/03* (2013.01); *A45F 2200/0525* (2013.01)

(58) Field of Classification Search

CPC .. A47B 3/10; A47B 83/00; A47B 5/00; A45C 13/28; A45C 2200/15; D06F 81/06

USPC ..... 108/42, 47, 48, 152; 190/11

See application file for complete search history.

(56) References Cited

U.S. PATENT DOCUMENTS

| | | | | | |
|---|---|---|---|---|---|
| 803,672 | A * | 11/1905 | Darrow | A47B 5/06 | 108/48 |
| 5,035,393 | A * | 7/1991 | Menaged | A47B 23/043 | 248/456 |
| 5,158,023 | A * | 10/1992 | Allen | E04G 5/00 | 108/42 |
| 5,845,585 | A * | 12/1998 | Meeus | B60N 3/005 | 108/165 |
| 6,038,983 | A * | 3/2000 | Lendl | B60N 3/005 | 108/44 |
| 6,240,857 | B1 * | 6/2001 | Elizer | A47B 97/04 | 108/147.17 |
| 7,946,609 | B2 * | 5/2011 | Johnson | A45C 5/14 | 280/47.19 |
| 8,079,312 | B2 * | 12/2011 | Long | B60N 3/005 | 108/152 |
| D687,040 | S * | 7/2013 | Meadows | D14/447 | |
| 8,613,349 | B1 * | 12/2013 | Halko | A45C 9/00 | 190/11 |

(Continued)

*Primary Examiner* — Jose V Chen

(74) *Attorney, Agent, or Firm* — Dunlap Bennett & Ludwig PLLC; Brendan E. Squire

(57) ABSTRACT

A desktop accessory for luggage includes a desktop platform and a support platform that may be conveniently hooked to the upright telescopic carrying handles of a carrier, such as a rollaway suitcase. The portable table is operable between a deployed condition for attachment to the carrier handles and a low profile stowed condition which may be conveniently stored in the luggage. This device can be applied to almost any existing suitcase and can be transferred from one to another.

20 Claims, 4 Drawing Sheets

(56) References Cited

U.S. PATENT DOCUMENTS

| | | | | |
|---|---|---|---|---|
| 8,763,537 | B2 * | 7/2014 | Ng | A47B 5/006 108/35 |
| 8,955,656 | B1 | 2/2015 | Foster et al. | |
| 9,282,795 | B2 | 3/2016 | King et al. | |
| 9,332,835 | B2 | 5/2016 | Shannon | |
| 9,474,346 | B2 | 10/2016 | Simon | |
| 9,498,055 | B2 | 11/2016 | Distefano | |
| 2008/0134430 | A1 * | 6/2008 | Kirmon | A01K 1/035 5/10.1 |
| 2008/0134946 | A1 | 6/2008 | Alonso et al. | |
| 2011/0209960 | A1 | 9/2011 | MacLean, III et al. | |
| 2016/0037905 | A1 | 2/2016 | Glover et al. | |
| 2016/0081469 | A1 | 3/2016 | Undesser | |
| 2016/0183677 | A1 * | 6/2016 | Achillopoulos | A45C 5/14 190/11 |

* cited by examiner

DESKTOP ACCESSORY FOR LUGGAGE

CROSS-REFERENCE TO RELATED APPLICATION

This application claims the benefit of priority of U.S. provisional application No. 62/422,911, filed Nov. 16, 2016, the contents of which are herein incorporated by reference.

BACKGROUND OF THE INVENTION

The present invention relates to travel accessories and, more particularly, to a desktop accessory for luggage.

While waiting at airports or bus stations travelers need a table or desk to hold their food, beverage, laptop, tablet, or other conveniences so they do not have to balance them on their lap or another seat.

Other devices are based on friction mount and do not hold much weight or are integrally formed to a specific suitcase.

As can be seen, there is a need for an improved travel desktop that can be applied to almost any existing suitcase and can be transferred from one to another.

SUMMARY OF THE INVENTION

In one aspect of the present invention, a portable table surface for adaptation to an upright handle of a rollaway carrier, includes a desktop platform having substantially flat top surface defined between a first end and a second end, a support platform having a first end and a second end, and a hinge at the second end for interconnection with the second end of the desktop platform and operable between a stowed position and a deployed position. A handle engagement slot is formed in the first end of the desktop platform and the first end of the support platform. The handle engagement slot is configured to receive the upright handle of the rollaway carrier to position the top surface of the desktop platform in a substantially horizontal orientation when attached to the upright handle in the deployed position.

In some embodiments, a support strut has a hinged connection to a lower surface of the top platform and is operable between a stowed position and a supporting position. The hinged connection may include a C-hinge. One or more slots may be defined across an upper surface of the support platform. The slots are configured to receive a free end of the support strut. A support strut opening may be defined in an upper surface of the support platform and is dimensioned to receive the support strut when the support strut and the support platform are in the stowed position.

In some embodiments, the handle engaging slot further includes an edge slot projecting inwardly from a lateral side edge of the desktop platform and the support platform. In other embodiments, the handle engaging slot may be an L-shaped slot, having a leg projecting inwardly from the first end of the desktop platform and the support platform and a base projecting laterally across a portion of the desktop platform and the support platform. In other embodiments, both the edge slot and the L shape slot may be employed.

In yet other embodiments of the portable table, a handle cutout may be defined in the second end of each of the desktop platform and the support platform. The handle cutout is configured to provide a hand hold for carrying the portable table when positioned in the stowed position. in some embodiments, a longitudinal length of the desktop platform is less than a longitudinal length of the support platform.

These and other features, aspects and advantages of the present invention will become better understood with reference to the following drawings, description and claims.

DETAILED DESCRIPTION OF THE INVENTION

Figure 1A:
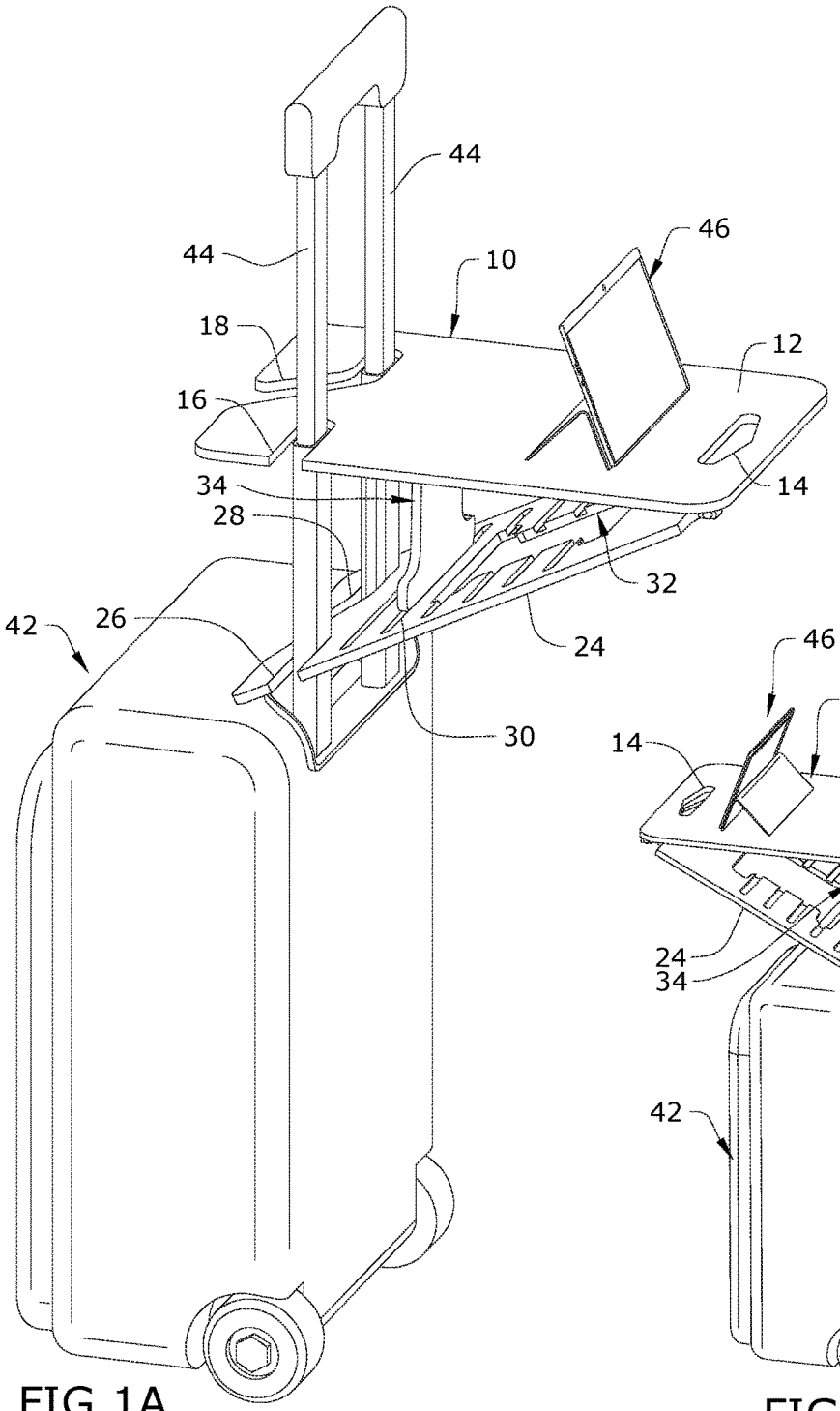
FIG. 1A is a perspective view of the portable table shown in use.
Figure 1B:
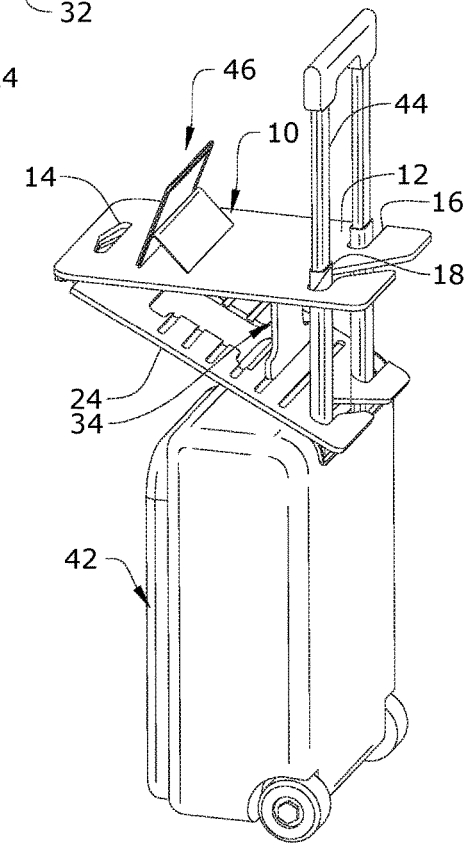
FIG. 1B is a perspective view of the portable table shown in use.
Figure 2:
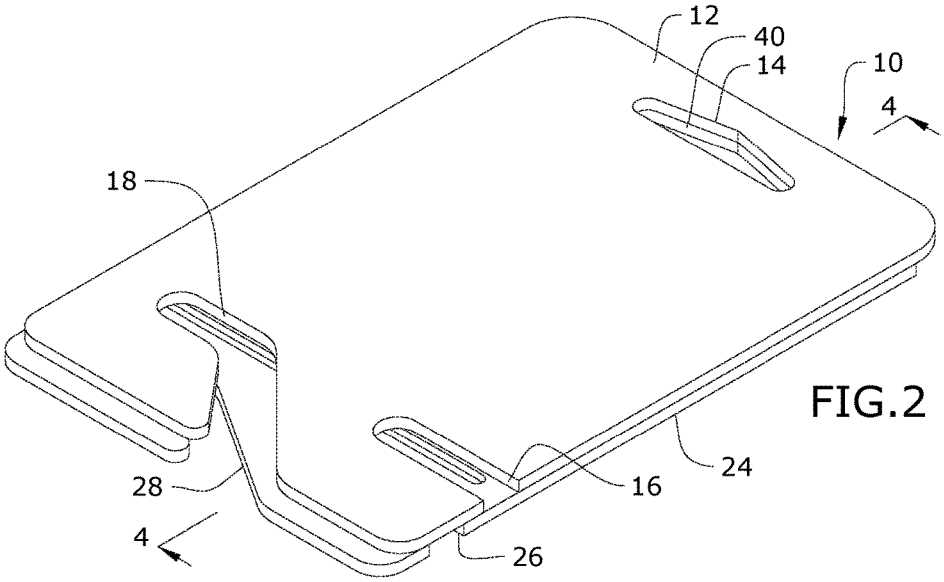
FIG. 2 is a top perspective view of the portable table shown in stowed configuration.
Figure 3:
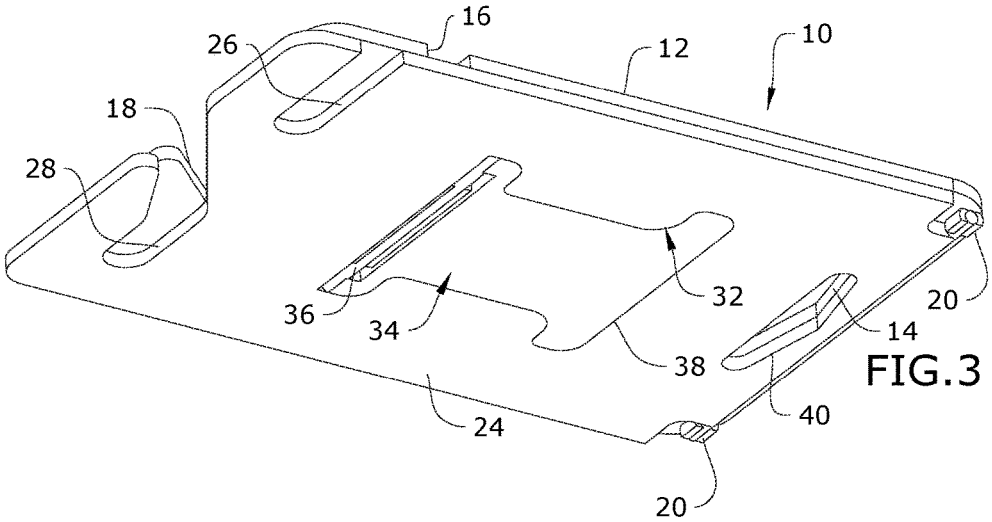
FIG. 3 is a bottom perspective view of the portable table shown in stowed configuration.
Figure 4:
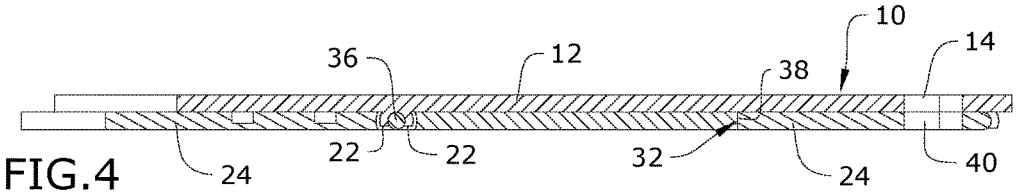
FIG. 4 is a section detail view of the portable table taken along line 4-4 in FIG. 2.
Figure 5:
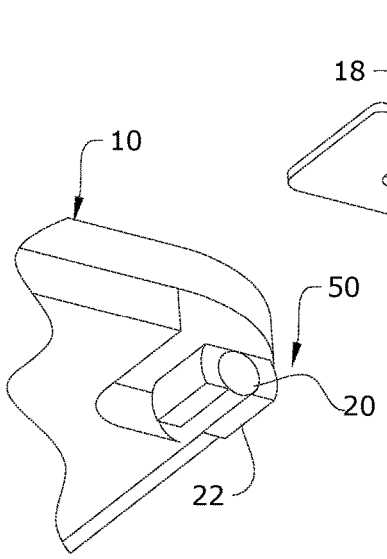
FIG. 5 is a bottom detail perspective view of the portable table demonstrating a corner hinge.
Figure 6:
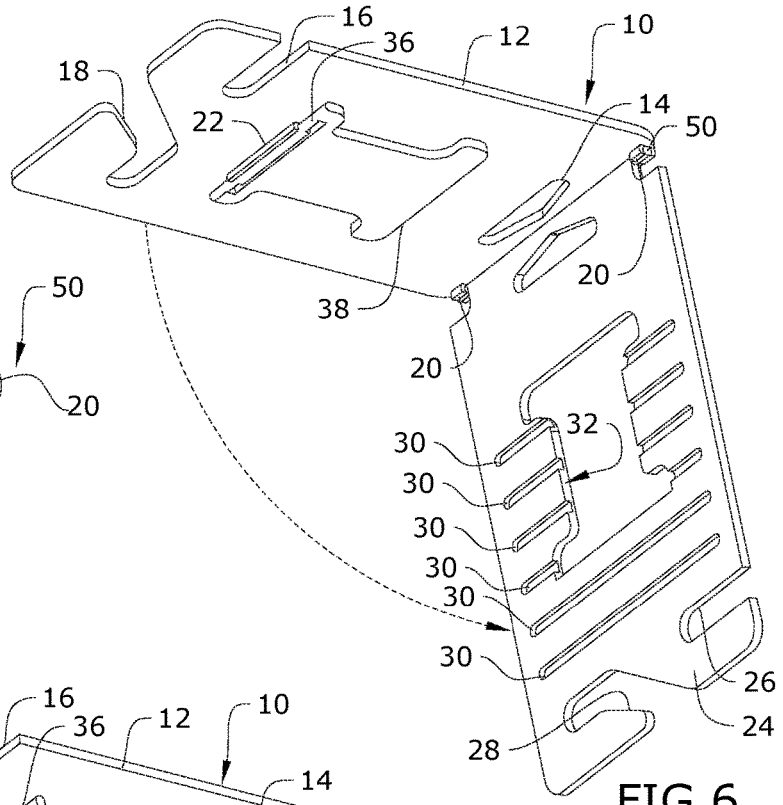
FIG. 6 is a bottom perspective view of the portable table demonstrating an exemplary relative platform component articulation.
Figure 7:
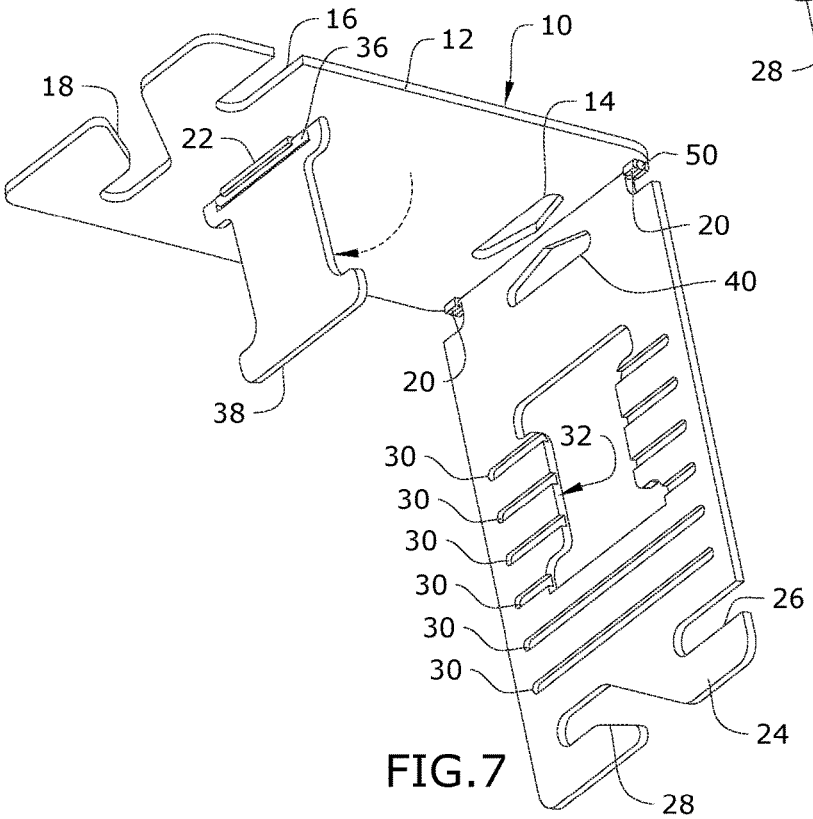
FIG. 7 is a bottom perspective view of the portable table demonstrating an exemplary support strut articulation.
Figure 8:
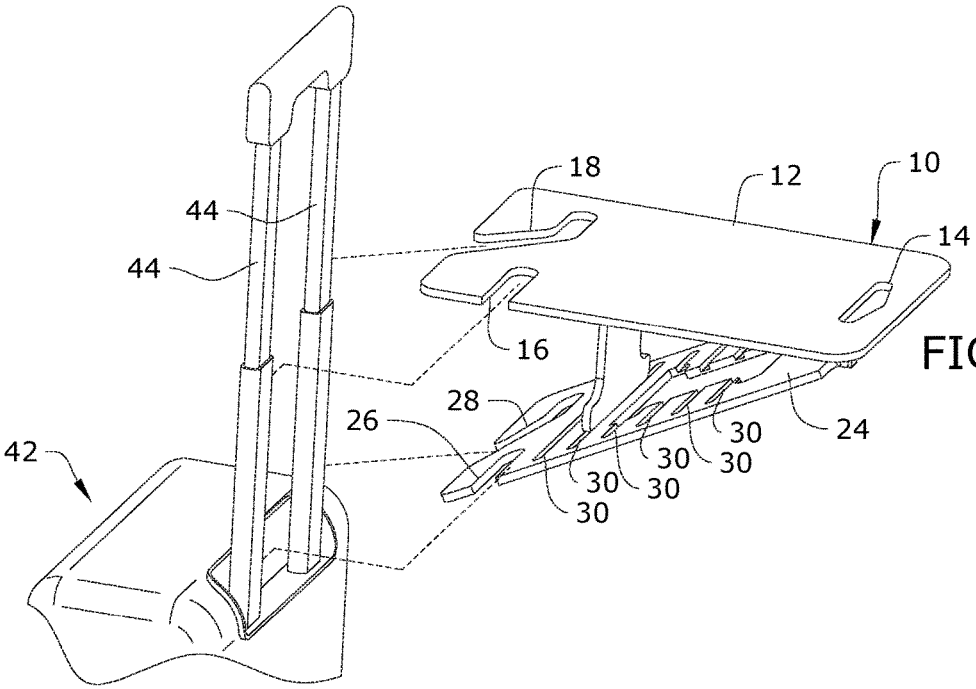
FIG. 8 is an exploded view of the portable table shown pre-application to luggage.
Figure 9:
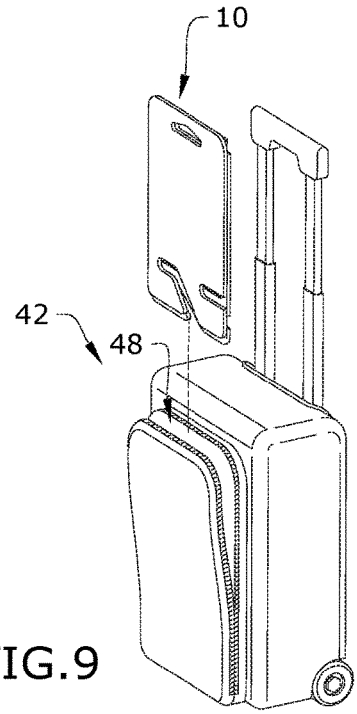
FIG. 9 is an exploded view of the portable table shown in folded stowed configuration.
Figure 10:
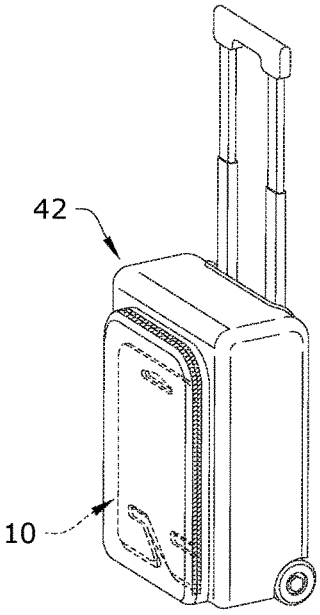
FIG. 10 Is a perspective view of the portable table shown in folded shown in a storage configuration.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides an improved portable desktop that may be applied to an upright handle of a carrier, such as a rollaway luggage carrier.

As seen in reference to the drawings, a portable table surface 10 for adaptation to an upright handle 44 of a rollaway carrier 42 includes a desktop platform 12 having substantially flat top surface defined between a first end and a second end. The desktop platform 12 has a handle engagement slot 16, 18 defined through the first end of the desktop platform 12.

A support platform 24 is provided and also has a first end and a second end. A hinge 50, such as the C-hinge having a pin 20 and a C-shaped receiver 20 is defined at the second end for interconnection the desktop platform 12. However, any suitable hinge 50 may be employed. The support platform 24 and the desktop platform 12 are operable about the hinge 50 between a stowed position and a deployed position.

At least one handle engagement slot is formed in the first end of the desktop platform 12 and the first end of the support platform 24. The at least one handle engagement slot is configured to receive the upright handle 44 of the rollaway carrier 42 to position the top surface of the desktop platform 12 in a substantially horizontal orientation when the desktop surface 10 is attached to the upright handle 44 in the deployed position.

The at least one handle engagement slot may include an edge slot 16 projecting inwardly from a lateral side edge of the desktop platform 12. An edge slot 26 may also be defined projecting inwardly from a lateral edge of the support platform 34. The at least one handle engaging slot may also include an L-shaped slot 18 having a leg projecting inwardly from the first end of the desktop platform 12 and a base projecting laterally across a portion of the desktop platform 12. An L-shaped slot 28 may also be defined in the support platform 14. As will be appreciated, the one or more handle engagement slot may be defined in just the desktop platform 12. In preferred embodiments, the one or more engagement slots are defined in each of the desktop platform 12 and the support platform 24 to provide the best stability to the portable table surface 10 when in use.

In the embodiment shown, a support strut opening 52, or recess, may be defined in an upper surface of the support platform 24. The support strut opening 52 is dimensioned to receive the support strut 34 therein when the support strut 34 and the support platform 24 are placed in the stowed position, permitting the portable desktop 10 to be transported and carried in a low profile, space saving condition. As will be appreciated, the support strut 34 may alternatively hinge about the support platform 34 and be received in a recess 52 in one of the support platform 24 or the desktop platform. For example, when placed in the stowed position, the portable desktop 10 may be conveniently in an outer storage compartment 48 of a luggage carrier.

A support strut 34 has a hinged connection to a lower surface of the top platform 12. The support strut 34 may be operable between a stowed position and a supporting position. The hinged connection comprises a C-hinge having a rib 36 that is carried in a C-shaped receiver 22. The rib 36 and the receiver 22 may be alternatively defined in the lower surface of the top platform 12 and the first end of the support strut 34. A free end 38 of the support strut 34 may include a strut support edge 38.

The strut support edge 38 is dimensioned to be received in one or more slots 30 defined across an upper surface of the support platform 24. The one or more slots 30 are configured to receive the free end 38 of the support strut 34 to maintain the desktop platform 12 and the support platform 24 in the deployed position.

The portable table surface 10 may also include a handle cutout 14 defined in the second end the desktop platform 12. A corresponding handle cutout 40 may be defined the second end of the support platform 24. The handle cutout 14, 40 are configured to provide a hand hold for carrying the portable table 10 when positioned in the stowed position.

It should be understood, of course, that the foregoing relates to exemplary embodiments of the invention and that modifications may be made without departing from the spirit and scope of the invention as set forth in the following claims.

What is claimed is:

1. A portable table surface adapted to attach to an upright handle of a rollaway carrier, comprising:

a desktop platform having substantially flat top surface defined between a first end and a second end, a support platform having a first end and a second end, and a hinge at the second end for interconnection with the second end of the desktop platform such that the support platform is operable between a stowed position and a deployed position; and a handle engagement slot formed in the first end of the desktop platform and the first end of the support platform, wherein the handle engagement slot is configured to receive the upright handle of the rollaway carrier by a lateral displacement of the engagement slots about the upright handle to position the top surface of the desktop platform in a substantially horizontal orientation with the support platform positioned subjacent to the desktop platform and extending between the hinge and the upright handle when attached to the upright handle of the rollaway carrier.

2. The portable table surface of claim 1, further comprising:

a support strut having a hinged connection to a lower surface of the top platform and operable between a stowed position and a supporting position.

3. The portable table surface of claim 2, wherein the hinged connection comprises a C-hinge.

4. The portable table surface of claim 2, further comprising:

one or more slots laterally defined across an upper surface of the support platform, wherein the one or more slots are configured to receive a free end of the support strut.

5. The portable table of claim 2, further comprising:

a support strut recess defined in an upper surface of the support platform, wherein the support strut recess is dimensioned to receive a body of the support strut when the support strut and the support platform are in the stowed position.

6. The portable table of claim 2, further comprising:

a handle cutout defined in the second end of each of the desktop platform and the support platform, the handle cutout configured to provide a hand hold for carrying the portable table when positioned in the stowed position.

7. The portable table of claim 1, wherein the handle engagement slot further comprises:

an edge slot projecting inwardly from a lateral side edge of the desktop platform and the support platform.

8. The portable table of claim 7, wherein the handle engagement slot further comprises:

an L-shaped slot having a leg projecting inwardly from the first end of the desktop platform and the support platform and a base projecting from the leg laterally across a portion of the desktop platform and the support platform, wherein the L-shaped slot is adapted to receive the handle through the leg then laterally within the base.

9. The portable table of claim 1, wherein the handle engaging slot further comprises:

an edge slot projecting inwardly from a lateral side edge of the desktop platform and the support platform; and an L-shaped slot having a leg projecting inwardly from the first end of the desktop platform and the support platform and a base projecting laterally across a portion of the desktop platform and the support platform.

10. The portable table of claim 1, wherein a longitudinal length of the desktop platform is less than a longitudinal length of the support platform.

11. A portable table surface adapted to attach to an upright handle of a rollaway carrier, comprising:

a desktop platform having substantially flat top surface defined between a first end and a second end, a support platform having a first end and a second end, and a hinge at the second end for interconnection with the second end of the desktop platform such that the support platform is operable between a stowed position and a deployed position; and a handle engagement slot formed in the first end of the desktop platform and the first end of the support platform, an edge slot defined in a lateral edge of the first end of the desktop platform and the support platform, wherein the handle engagement slot and the edge slot are configured to laterally receive the upright handle of the rollaway carrier to position the top surface of the desktop platform in a substantially horizontal orientation when attached to the upright handle of the rollaway carrier when the upright handle is in an extended position.

12. The portable table surface of claim 11, wherein the support platform is positioned subjacent to the desktop platform and extends between the hinge and the upright handle.

13. The portable table surface of claim 11, further comprising:

a support strut having a hinge connection to one of a lower surface of the top platform and an upper surface of the support platform and operable between a stowed position and a supporting position; and one or more slots defined across one of a lower surface of the top platform and an upper surface of the support platform an upper surface of the support platform opposite the hinge connection, wherein the one or more slots are configured to receive a free end of the support strut.

14. The portable table of claim 11, further comprising:

a support strut having a hinge connection to one of a lower surface of the top platform and an upper surface of the support platform and operable between a stowed position and a supporting position; and a support strut recess defined in one of a lower surface of the top platform and an upper surface of the support platform opposite the hinge connection, wherein the support strut recess is dimensioned to receive the support strut when the support strut and the support platform are in the stowed position.

15. The portable table of claim 11, wherein the handle engagement slot further comprises:

an L-shaped slot having a leg projecting inwardly from the first end of the desktop platform and the support platform and a base projecting laterally across a portion of the desktop platform and the support platform.

16. The portable table of claim 11, further comprising:

a handle cutout defined in the second end of each of the desktop platform and the support platform, the handle cutout configured to provide a hand hold for carrying the portable table when positioned in the stowed position.

17. A portable table surface adapted to attach to an upright handle of a rollaway carrier, comprising:

a desktop platform having substantially flat top surface defined between a first end and a second end, a support platform having a first end and a second end, and a hinge at the second end for interconnection with the second end of the desktop platform;

a handle engagement slot formed in the first end of the desktop platform and the first end of the support platform, wherein the handle engagement slot is configured to receive the upright handle of the rollaway carrier to position the top surface of the desktop platform in a substantially horizontal when attached to the upright handle of the rollaway carrier when the upright handle is in an extended position;

a support strut having a hinge connection to one of a lower surface of the top platform and an upper surface of the support platform and operable between a stowed position and a supporting position; and a support strut recess defined in one of a lower surface of the top platform and an upper surface of the support platform, opposite the hinge connection, wherein the support strut recess is dimensioned to receive a body of the support strut when the support strut and the support platform are in the stowed position.

18. The portable table surface of claim 17, further comprising:

one or more slots defined laterally across an upper surface of the support platform, wherein the slots are configured to receive a free end of the support strut.

19. The portable table of claim 1, wherein the handle engagement slot further comprises:

an edge slot projecting inwardly from a lateral side edge of the desktop platform and the support platform.

20. The portable table of claim 1, wherein the handle engagement slot further comprises:

an L-shaped slot having a leg projecting inwardly from the first end of the desktop platform and the support platform and a base projecting laterally across a portion of the desktop platform and the support platform.

* * * * *